US009743754B2

(12) United States Patent
Ergun et al.

(10) Patent No.: US 9,743,754 B2
(45) Date of Patent: Aug. 29, 2017

(54) GAS SPRING LIFT

(71) Applicant: Ergotron, Inc., St. Paul, MN (US)

(72) Inventors: Mustafa A. Ergun, Plymouth, MN (US); Chelsea Cross, Bloomington, MN (US)

(73) Assignee: Ergotron, Inc., St. Paul, MN (US)

( * ) Notice: Subject to any disclaimer, the term of this patent is extended or adjusted under 35 U.S.C. 154(b) by 0 days.

(21) Appl. No.: 15/185,678

(22) Filed: Jun. 17, 2016

(65) Prior Publication Data

US 2017/0020279 A1 Jan. 26, 2017

Related U.S. Application Data

(60) Provisional application No. 62/195,140, filed on Jul. 21, 2015.

(51) Int. Cl.
*A47B 9/00* (2006.01)
*A47B 9/02* (2006.01)
(Continued)

(52) U.S. Cl.
CPC ..... *A47B 9/02* (2013.01); *A47B 9/10* (2013.01); *A47B 9/12* (2013.01); *A47B 9/20* (2013.01);
(Continued)

(58) Field of Classification Search
CPC .... A47B 9/02; A47B 9/10; A47B 9/12; A47B 9/20; A47B 13/02; A47B 13/023; A47B 13/16
See application file for complete search history.

(56) References Cited

U.S. PATENT DOCUMENTS 4,559,879 A 12/1985 Hausser
4,651,652 A 3/1987 Wyckoff
(Continued)

FOREIGN PATENT DOCUMENTS

DE 1529723 1/1970
DE 1529723 A1 1/1970
(Continued)

OTHER PUBLICATIONS

"International Application Serial No. PCT/US2016/038092, International Search Report mailed Sep. 14, 2016", 5 pgs.
(Continued)

*Primary Examiner* — Hanh V Tran
(74) *Attorney, Agent, or Firm* — Schwegman Lundberg & Woessner, P.A.

(57) ABSTRACT

A height adjustable device that can include: a work surface; and at least one leg assembly connected to the work surface, the at least one leg assembly including: a first member; and a second member moveable relative to the first member along a longitudinal axis; a counterbalance mechanism connected to the height adjustable device and configured to counteract a force exerted on the work surface, the counterbalance mechanism including: a gas spring having a cylinder and a moveable piston; a wheel moveably connected to the gas spring; and first tension member engaged to the wheel, the first tension member connected to the at least one leg assembly; a second tension member engaged to the wheel, the second tension member connected to the at least one leg assembly; and a guide member mounted inside of one of the first member and the second member, the guide member being slidably engaged with the cylinder.

20 Claims, 17 Drawing Sheets

(51) Int. Cl.

| | |
|---|---|
| ***A47B 9/10*** | (2006.01) |
| ***A47B 9/12*** | (2006.01) |
| ***A47B 9/20*** | (2006.01) |
| ***A47B 13/02*** | (2006.01) |
| *A47B 13/16* | (2006.01) |

(52) U.S. Cl.
CPC ..... *A47B 13/02* (2013.01); *A47B 13/023* (2013.01); *A47B 13/16* (2013.01)

(56) References Cited

U.S. PATENT DOCUMENTS

| | | | | |
|---|---|---|---|---|
| 5,114,109 | A | 5/1992 | Fitz et al. | |
| 5,400,721 | A * | 3/1995 | Greene | A47B 9/02 108/147 |
| 5,682,825 | A * | 11/1997 | Manner | A47B 9/02 108/144.11 |
| 5,715,759 | A * | 2/1998 | Lee | A47B 9/12 108/147 |
| 6,474,246 | B2 * | 11/2002 | Hsu | A47B 9/04 108/147 |
| 7,204,193 | B2 | 4/2007 | Scherrer et al. | |
| 7,364,124 | B2 * | 4/2008 | Yuasa | F16M 11/18 248/125.8 |
| 7,658,359 | B2 * | 2/2010 | Jones | A47B 9/00 108/147 |
| 7,743,716 | B1 | 6/2010 | Burka | |
| 7,752,932 | B2 | 7/2010 | Chen et al. | |
| 8,177,174 | B2 | 5/2012 | Griepentrog | |
| 8,333,159 | B2 | 12/2012 | Schroer et al. | |
| 8,342,465 | B2 * | 1/2013 | Koder | A47B 9/04 108/147 |
| 2005/0002591 | A1 | 1/2005 | Buitmann | |
| 2008/0250989 | A1 * | 10/2008 | Kozlowski | F16M 11/046 108/147 |
| 2009/0072101 | A1 * | 3/2009 | Stoelinga | A47B 9/12 248/188.5 |
| 2011/0001032 | A1 * | 1/2011 | Gardner | A47B 21/0073 248/404 |
| 2012/0227642 | A1 | 9/2012 | Sekikawa | |
| 2012/0248273 | A1 | 10/2012 | Singer | |
| 2013/0126682 | A1 | 5/2013 | Tholkes et al. | |
| 2014/0034799 | A1 | 2/2014 | Fallows et al. | |
| 2015/0047538 | A1 | 2/2015 | Ergun et al. | |

FOREIGN PATENT DOCUMENTS

| | | | |
|---|---|---|---|
| EP | 1987734 | B1 | 12/2010 |
| EP | 2422647 | A1 | 2/2012 |
| WO | WO-9919247 | A1 | 4/1999 |
| WO | WO-2008145399 | A1 | 12/2008 |
| WO | WO-2012025593 | A1 | 3/2012 |
| WO | WO-2017014877 | A1 | 1/2017 |

OTHER PUBLICATIONS

"International Application Serial No. PCT/US2016/038092, Written Opinion mailed Sep. 14, 2016", 7 pgs.

* cited by examiner

GAS SPRING LIFT

CLAIM OF PRIORITY

This patent application claims the benefit of U.S. Provisional Patent Application Ser. No. 62/195,140, titled "GAS SPRING LIFT," by Mustafa Ergun et al., and filed on Jul. 21, 2015, which is hereby incorporated by reference herein in its entirety.

TECHNICAL FIELD

The disclosure generally relates to systems and methods for height adjustable desks/workstations.

BACKGROUND

Height adjustable work surfaces and workstations can be used in sit-to-stand applications.

OVERVIEW

Height adjustable devices can be used in many applications, such as desks, tables, work stands, and display stands. The present inventors recognized a need for a height adjustable device that can include a telescoping or adjustable beam that can include a first member, a second member and a gas spring. In the present application the "adjustable beam" can also be known as a "leg assembly". The height adjustable device can include a work surface, such as a table top or desk top. The adjustable beam can be attached to a base at one end and to the bottom of a work surface at the other end. The gas spring can be part of a counterbalance mechanism that can support weight located on the work surface and allow the work surface to be raised or lowered easily. The counter balance mechanism can include one or more tension members configured such that movement of the gas spring can cause the second member to move relative to the first member. The height adjustable device can include a gas spring release pin that can be actuated to allow a height adjustment of the height adjustable device. A portion of the gas spring, such as the cylinder, can be allowed to move relative to the first or second members. The cylinder can slidably engage guide members that can be attached to one or both of the first or second members. The guide members can stabilize and guide movement of the cylinder. In another example, the cylinder can be fixed relative to the first or second members and the piston of the gas spring can be allowed to move relative to the first and second members.

Other height adjustable techniques are disclosed in U.S. Provisional Patent Application No. 62/035,700 to Mustafa Ergun et al., titled "Height Adjustable Desk System and Method" and filed Aug. 11, 2014, and in U.S. patent application Ser. No. 14/461,932 to Mustafa Ergun et al., titled "Height Adjustable Desk System and Method" and filed Aug. 18, 2014, the entire disclosures of each being incorporated herein by reference.

To further illustrate the GAS SPRING LIFT disclosed herein, a non-limiting list of examples is provided here:

In Example 1, a height adjustable device can comprise a work surface; and at least one leg assembly connected to the work surface, the at least one leg assembly including: a first member; and a second member moveable relative to the first member along a longitudinal axis; a counterbalance mechanism connected to the height adjustable device and configured to counteract a force exerted on the work surface, the counterbalance mechanism including: a gas spring having a cylinder and a moveable piston; a wheel moveably connected to the gas spring; and a first tension member engaged to the wheel, the first tension member connected to the at least one leg assembly; a second tension member engaged to the wheel, the second tension member connected to the at least one leg assembly; and a guide member mounted inside of one of the first member and the second member, the guide member being slidably engaged with the cylinder.

In Example 2, the height adjustable device of Example 1 can optionally be configured such that the cylinder is configured to move within the at least one leg assembly when the moveable piston moves.

In Example 3, the height adjustable device of any one or any combination of Examples 1-2 can optionally be configured such that the second member slides within the first member in a telescoping configuration.

In Example 4, the height adjustable device of any one or any combination of Examples 1-3 can optionally be configured to further comprise a release mechanism configured to release the gas spring.

In Example 5, the height adjustable device of Example 4 can optionally be configured such that the release mechanism includes a release bar having a middle section configured to coincide with a rotation axis.

In Example 6, the height adjustable device of any one or any combination of Examples 1-5 can optionally be configured such that a distal end of the moveable piston is coupled to the work surface.

In Example 7, the height adjustable device of any one or any combination of Examples 1-6 can optionally be configured to further comprise a third member moveable relative to the first member and the second member along the longitudinal axis.

In Example 8, the height adjustable device of any one or any combination of Examples 1-7 can optionally be configured such that the guide member is mounted inside of the second member.

In Example 9, the height adjustable device of any one or any combination of Examples 1-8 can optionally be configured to further comprise a wheeled base having a tapered cavity configured to receive the first member.

In Example 10, a height adjustable device can comprise: a work surface; and at least one leg assembly connected to the work surface, the at least one leg assembly including: a first member; and a second member moveable relative to the first member along a longitudinal axis; a counterbalance mechanism connected to the height adjustable device and configured to counteract a force exerted on the work surface, the counterbalance mechanism including: a gas spring having a cylinder and a moveable piston; a first wheel moveably connected to the gas spring;

a second wheel moveably connected to the gas spring; and a first tension member engaged to the first wheel, the first tension member connected to the at least one leg assembly;

a second tension member engaged to the second wheel, the second tension member connected to the at least one leg assembly; and a guide member mounted inside of one of the first member and the second member, the guide member being slidably engaged with the cylinder.

In Example 11, the height adjustable device of Example 10 can optionally be configured such that the first wheel and the second wheel rotate about a first axis.

In Example 12, the height adjustable device of any one or any combination of Examples 10-11 can optionally be configured such that the first and second tension members are configured such that the first and second wheels rotate in the same direction when the second member moves.

In Example 13, the height adjustable device of any one or any combination of Examples 10-11 can optionally be configured such that the first and second tension members are configured such that the first and second wheels rotate in opposite directions when the second member moves.

In Example 14, the height adjustable device of any one or any combination of Examples 10-13 can optionally be configured to further comprise a release mechanism configured to release the gas spring.

In Example 15, the height adjustable device of Example 14 can optionally be configured such that the release mechanism includes a release bar having a middle section configured to coincide with a rotation axis.

In Example 16, the height adjustable device of any one or any combination of Examples 10-15 can optionally be configured such that a distal end of the moveable piston is coupled to the work surface.

In Example 17, the height adjustable device of any one or any combination of Examples 10-16 can optionally be configured to further comprise a third member moveable relative to the first member and the second member along the longitudinal axis.

In Example 18, the height adjustable device of any one or any combination of Examples 10-17 can optionally be configured such that the guide member is mounted inside of the second member.

In Example 19, the height adjustable device of any one or any combination of Examples 10-18 can optionally be configured such that the second member slides within the first member in a telescoping configuration.

In Example 20, a height adjustable device can comprise: a work surface; and at least one leg assembly connected to the work surface, the at least one leg assembly including: a first member; and a second member moveable relative to the first member along a longitudinal axis in a telescoping configuration; a counterbalance mechanism connected to the height adjustable device and configured to counteract a force exerted on the work surface, the counterbalance mechanism including: a gas spring having a cylinder and a moveable piston, the moveable piston coupled to the work surface; a first wheel moveably connected to the gas spring; a second wheel moveably connected to the gas spring, wherein the first and second wheels rotate about a common axis; a first tension member engaged to the first wheel, the first tension member connected to the at least one leg assembly; a second tension member engaged to the second wheel, the second tension member connected to the at least one leg assembly, wherein the first and second tension members are configured such that the first and second wheels rotate in opposite directions when the second member moves; and a guide member mounted inside of one of the first member and the second member, the guide member being slidably engaged with the cylinder, wherein the cylinder is configured to move within the at least one leg assembly when the moveable piston moves.

In Example 21, a height adjustable device of any one or any combination of Examples 1-20 can optionally be configured such that all elements, operations, or other options recited are available to use or select from.

These and other examples and features of the present height adjustable device will be set forth in part in the following Detailed Description. This Overview is intended to provide non-limiting examples of the present subject matter—it is not intended to provide an exclusive or exhaustive explanation, The Detailed Description below is included to provide further information about the present height adjustable device and lift mechanisms.

BRIEF DESCRIPTION OF THE DRAWINGS

The examples set out herein illustrate examples of the invention, and such examples are not to be construed as limiting the scope of the invention in any manner.

The drawings illustrate generally, by way of example, but not by way of limitation, various examples discussed in the present document.

The scope of the invention should be determined with reference to the appended claims, along with the full scope of equivalents to which such claims are entitled.

DETAILED DESCRIPTION

Figure 1:
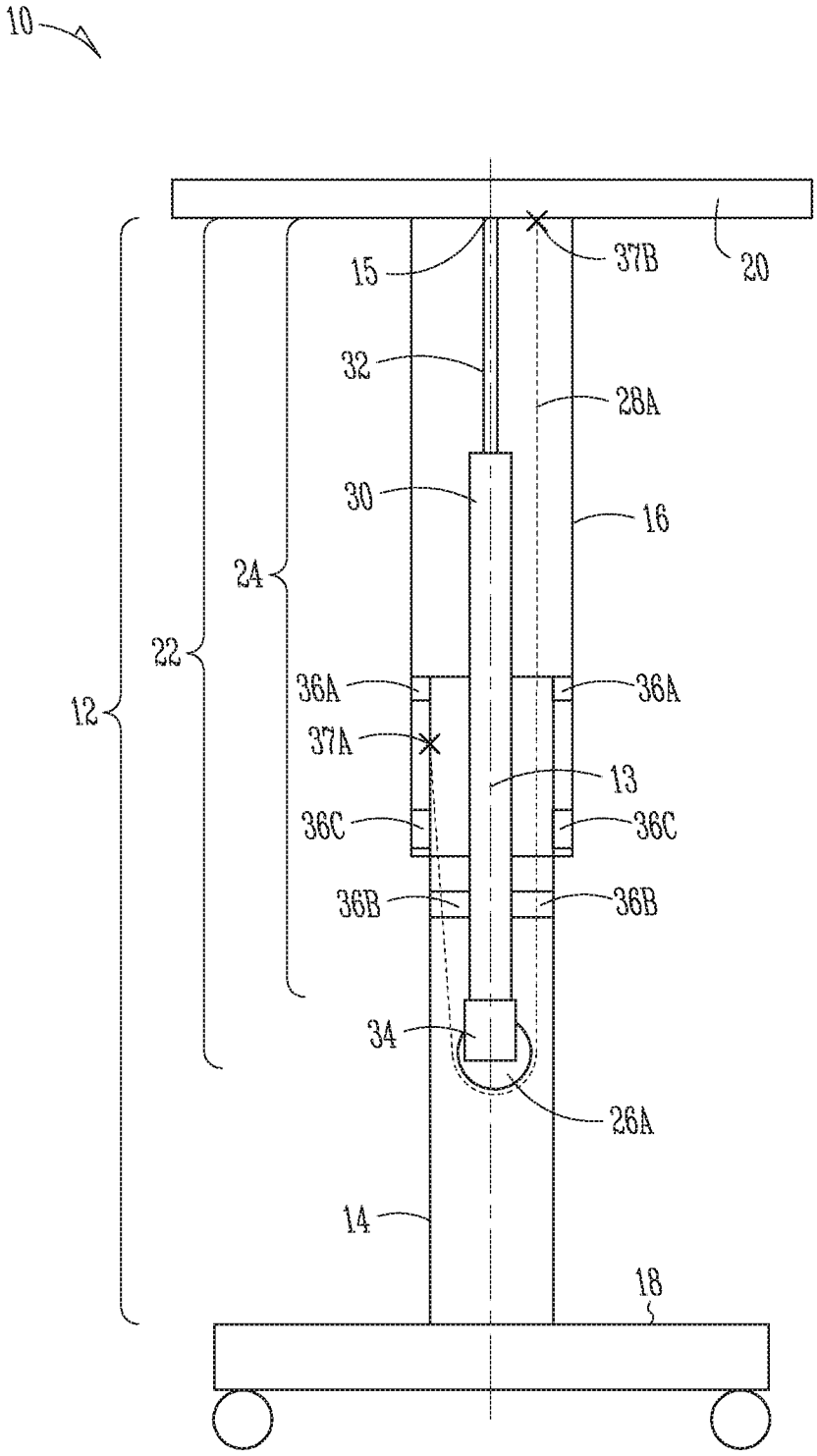
FIG. 1 illustrates a front partially cutaway view (illustrating internal structures) of a height adjustable device, in accordance with at least one example of the present disclosure.

FIG. 1 illustrates a front partially cutaway view of a height adjustable device 10 (illustrating internal structures), in accordance with at least one example of the present disclosure. The height adjustable device 10 can include an adjustable beam 12, a first member 14, a second member 16, a base 18, a work surface 20 and a counterbalance mechanism 22. The adjustable beam 12 can be attached to the base 18 at one end and to the work surface 20 at the other end. The second member 16 can be slidably engaged with the first member 14 and the second member 16 can move relative to the first member 14 along a longitudinal axis 13. The second member 16 can be slightly in larger cross-section so that the first member 14 can be at least partially located inside the second member 16 Although the sliding or telescoping members such as the first member 14 and the second member 16 may be illustrated as rectangular or circular in cross section, any cross-sectional shape allowing one member to slide within or on the outside of another member is contemplated by the inventors of the present disclosure. Although the work surface 20 is illustrated as being adjustable with one adjustable beam 12, the present inventors have contemplated any size work surface that can be raised and lowered by any number of adjustable beams or telescoping legs.

The counterbalance mechanism 22 can include a gas spring 24, a first pulley 26A, and a first tension member 28A. The gas swing 24 can include a cylinder 30 and a piston 32. The cylinder 30 can be slidably engaged with the piston 32 and can include a gas charge as is well known in the art. The piston 32 can be fixedly attached to the work surface 20. The cylinder 30 can be at least partially inside the first member 14. A pulley attachment bracket 34 can be fixedly attached to the lower end of the cylinder 30. The first pulley 26A can be rotatingly coupled to the cylinder 30 with the pulley attachment bracket 34. A distal end 15 of the piston 32 can be the end furthest from the cylinder 30 when the piston 32 is extended.

A first guide member 36A can be fixedly attached proximate to an outer upper end of the first member 14, and can be slidably engaged with an inside surface of the second member 16A second guide member 36B can be fixedly attached to an inside surface of the first member 14, and can be slidably engaged with the outside surface of the cylinder 30. In some examples, a third guide member 36C can be fixedly attached to the second member 16 proximate the lower edge and can be slidably engaged with the outside surface of the first member 14. The guides can be made of one-piece molded plastic. However, in some configurations, multiple pieces of molded plastic guides, or tapes made up of low friction materials such as Teflon can be used as gliding surfaces between adjacent telescoping members. Molded plastics can include bumps to provide smaller contact surfaces between the telescoping members to lower the friction. Grease can be used over the gliding surfaces to reduce friction. In other configurations, guide can be replaced by vertical slides to guide the telescoping members relative to each other. In an example, cross-sectional configurations of a guide can include a rectangular shape. in another example, cross-sectional configurations of guides can match any curved, oval, polygonal, or irregular shape of a tube/member.

A first end 37A of the first tension member 28A can be attached to the first member 14. The first tension member 28A can be routed around the first pulley 26A, and the second end 37B of the first tension member 28A can be attached to the second member 16 (or in the alternative coupled to the work surface 20).

Figure 2:
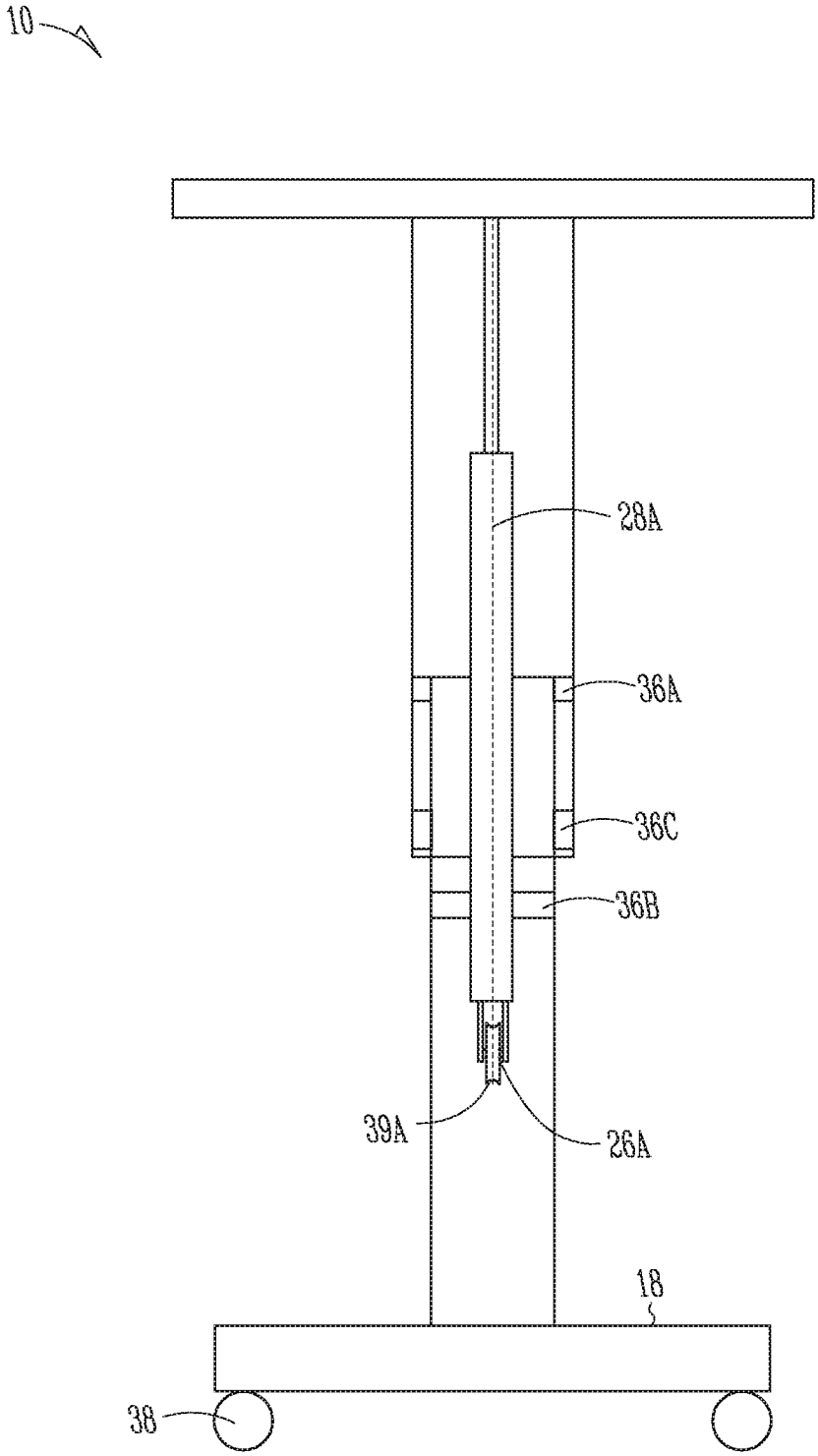
FIG. 2 illustrates a side partially cutaway view of the height adjustable device of FIG. 1, in accordance with at least one example of the present disclosure.

FIG. 2 illustrates a side partially cutaway view of the height adjustable device 10 of FIG. 1, in accordance with at least one example of the present disclosure. The first tension member 28A can be located in a first groove 39A in the first pulley 26A. The first groove 39A can be a channel or indentation that keeps the tension member aligned and in place on the pulley wheel. Caster wheels 38 can be attached to the base 18 and allow the height adjustable device 10 to be moved easily. The first guide member 36A, second guide member 36B, and third guide member 36C are shown.

Figure 3:
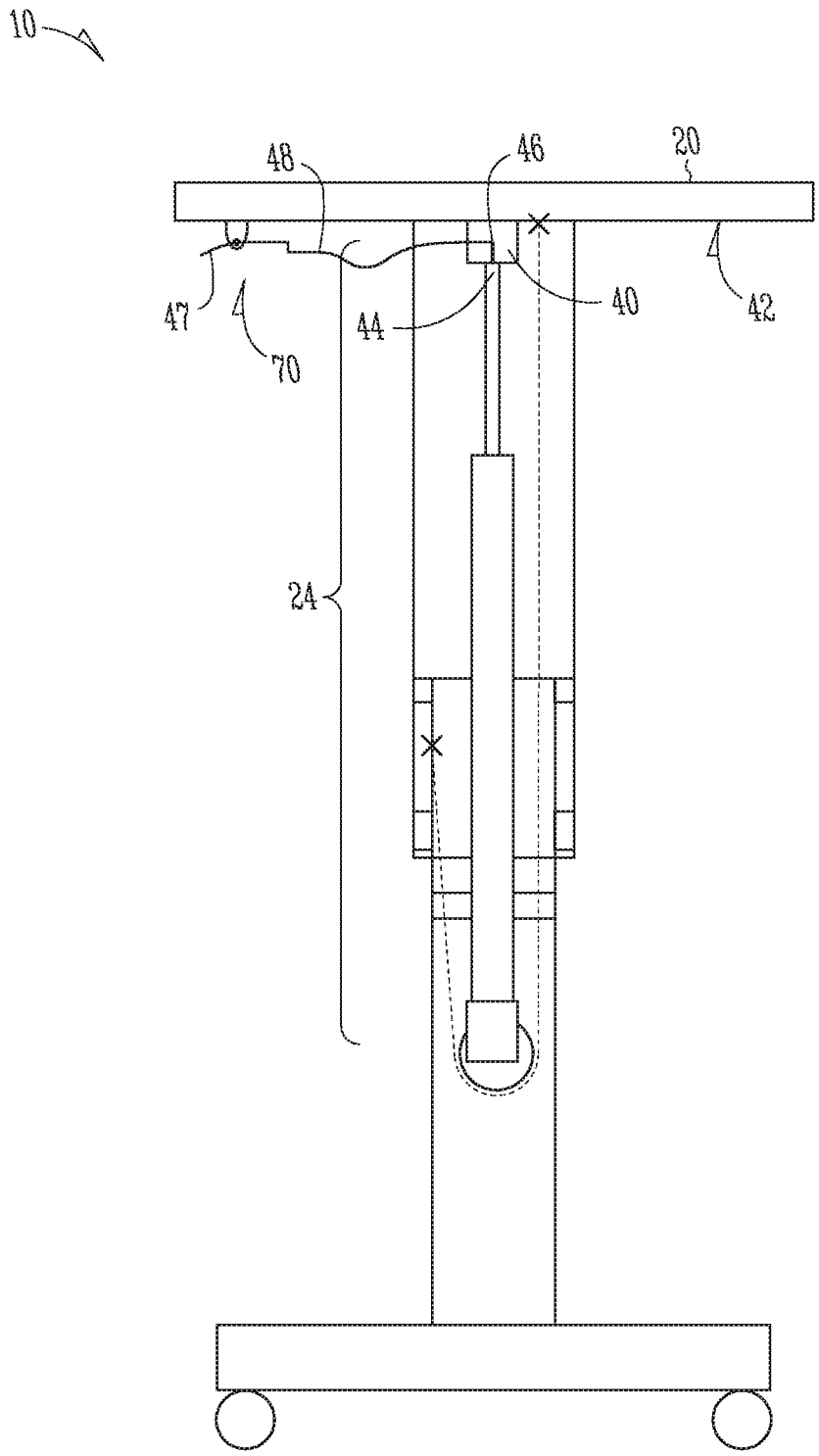
FIG. 3 illustrates a front partially cutaway view of a height adjustable device, in accordance with at least one example of the present disclosure.

FIG. 3 illustrates a front partially cutaway view of a height adjustable device 10, in accordance with at least one example of the present disclosure. In some examples, the gas spring 24 can be attached to the work surface 20 using a gas spring attachment bracket 40 in a configuration such that there is enough distance between bottom surface 42 of the work surface 20 and the top end 44 of the gas spring 24 to allow actuation of a gas spring release pin 46.

A release lever 47 can be attached to the bottom surface 42 of the work surface 20, and can be connected to the gas spring release pin 46 using a cable 48 such as a brake cable. In other examples, a release mechanism 70 can be configured using brackets and rods to connect the release lever 47 to the gas spring release pin 46. When a user squeezes the release lever 47, the gas spring release pin 46 is pressed or actuated, and the gas spring 24 can be released so that the work surface height can be adjusted.

Figure 4:
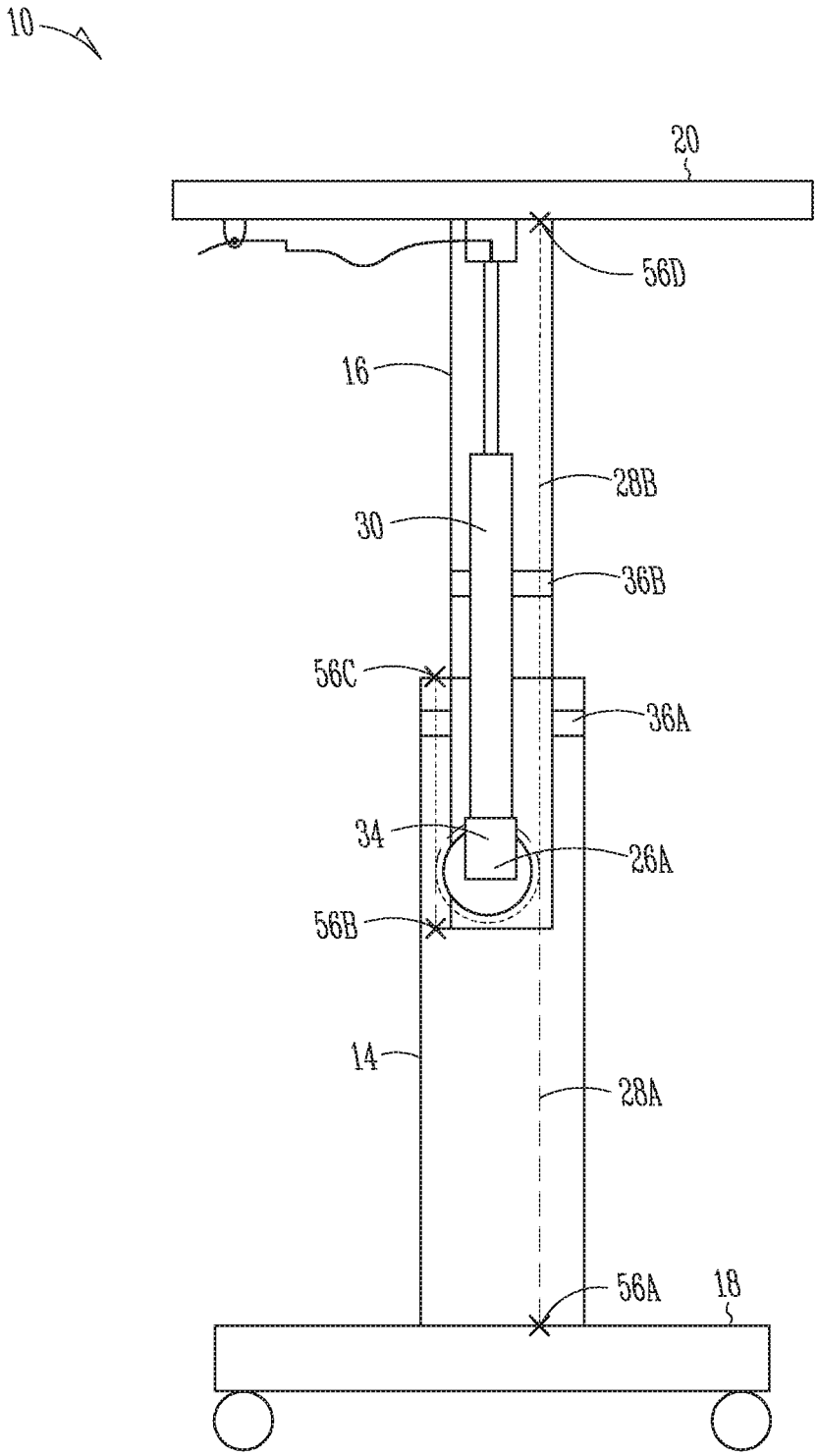
FIG. 4 illustrates a front partially cutaway view of a height adjustable device, in accordance with at least one example of the present disclosure.

FIG. 4 illustrates a front partially cutaway view of a height adjustable device 10, in accordance with at least one example of the present disclosure. In some examples, the second member 16 can have a smaller cross-section, and can be at least partially located inside the first member 14. In this configuration, the location of guide members 36A, 36B can be slightly modified to provide support between the sliding first and second members 14, 16 and also between the cylinder 30 and the second member 16.

In some examples, two tension members can be used together with two pulleys. A first pulley 26A and a second pulley 26B (see FIG. 5) can be located on the same axle, and they can be rotatingly coupled with the pulley attachment bracket 34. The first pulley 26A and the second pulley 26B can be on the same or common axis of rotation. In another example, the present inventors have contemplated more than two or more pulleys on different axes of rotation.

One end of a first tension member 28A can be attached to the first member 14 at a first crimp 56A, and can be routed around the first pulley 26A. In another example, the first tension member 28A can be attached to the base 18 at the first crimp 56A. The other end of the first tension member 28A can be attached to the second member 16 at a second crimp 56B. One end of a second tension member 28B can be attached to the first member 14 at a third crimp 56C and can be routed around the second pulley 26B (see FIG. 5). The other end of the second tension member 28B can be attached to either the second member 16 or the work surface 20 at a fourth crimp 56D.

In an example, the pulley attachment bracket 34 and first and second pulley wheels 26A, 26B can be at least partially located within the second member 16. The second tension member 28B can extend from within the second member 16 by means such as an opening or a slot in the second member to couple to the third crimp 56C on the first member 14. In an alternate example, a rod can extend from the base 18 or the first member 14 into the second member 16 and be located at a height to provide a location for a third crimp 56C.

In this example, the configuration of routing the first and second tension members 28A, 28B over the first and second pulleys 26A, 26B, respectively, can cause the pulleys 26A, 26B to rotate in opposite directions as the work surface 20 is raised or lowered. In this example the first pulley 26A and second pulley 26B can be two separate components.

Figure 5:
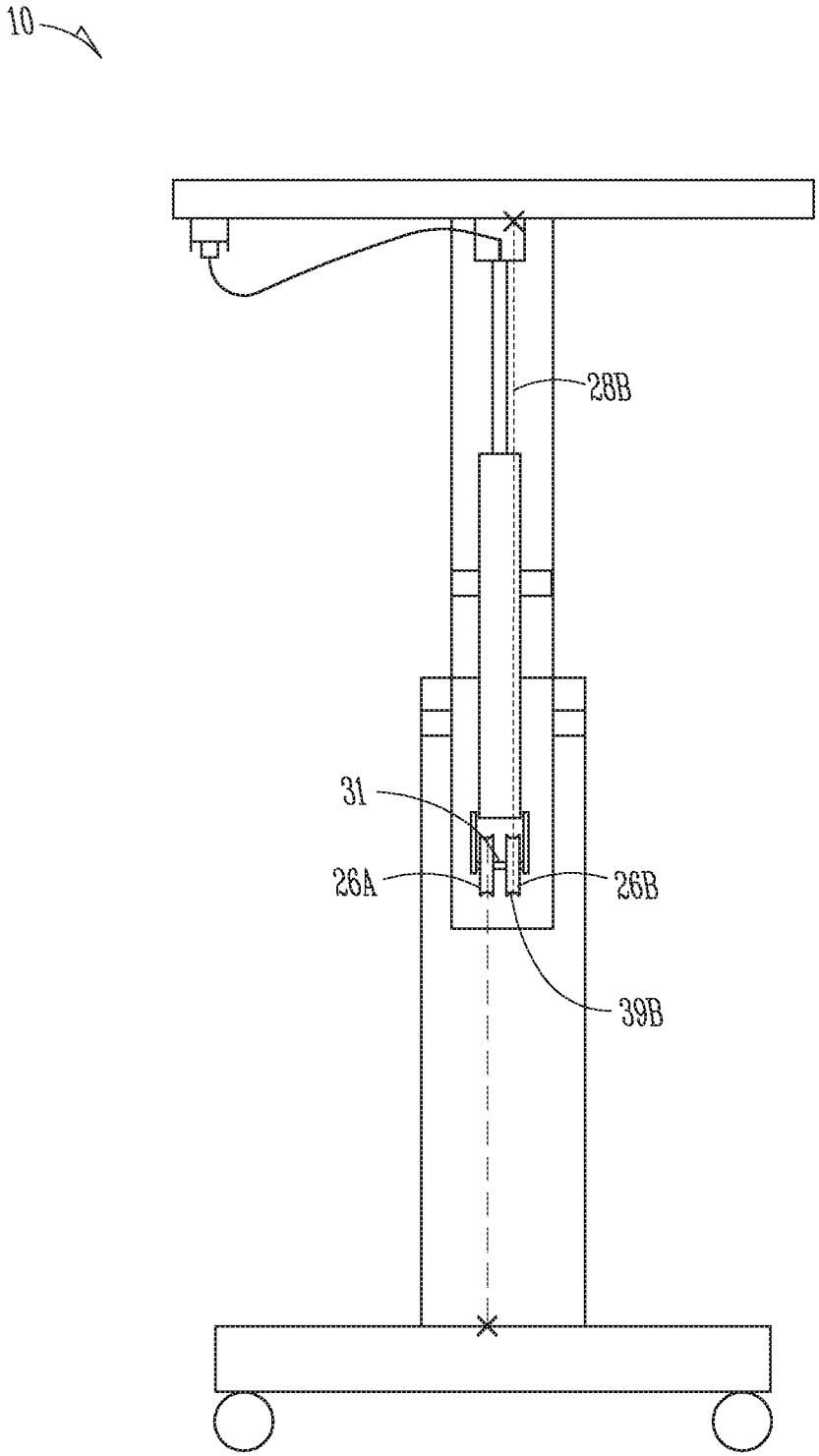
FIG. 5 illustrates a side partially cutaway view of the height adjustable device of FIG. 4, in accordance with at least one example of the present disclosure.

FIG. 5 illustrates a side partially cutaway view of the height adjustable device 10 of FIG. 4, in accordance with at least one example of the present disclosure. In this example, the first pulley 26A and second pulley 26B are two separate components which can be mounted on the same axle 31. The pulleys 26A and 26B can rotate in opposite directions. The second tension member 28B can be located in a second groove 39B that can be located in the second pulley 26B.

Figure 6:
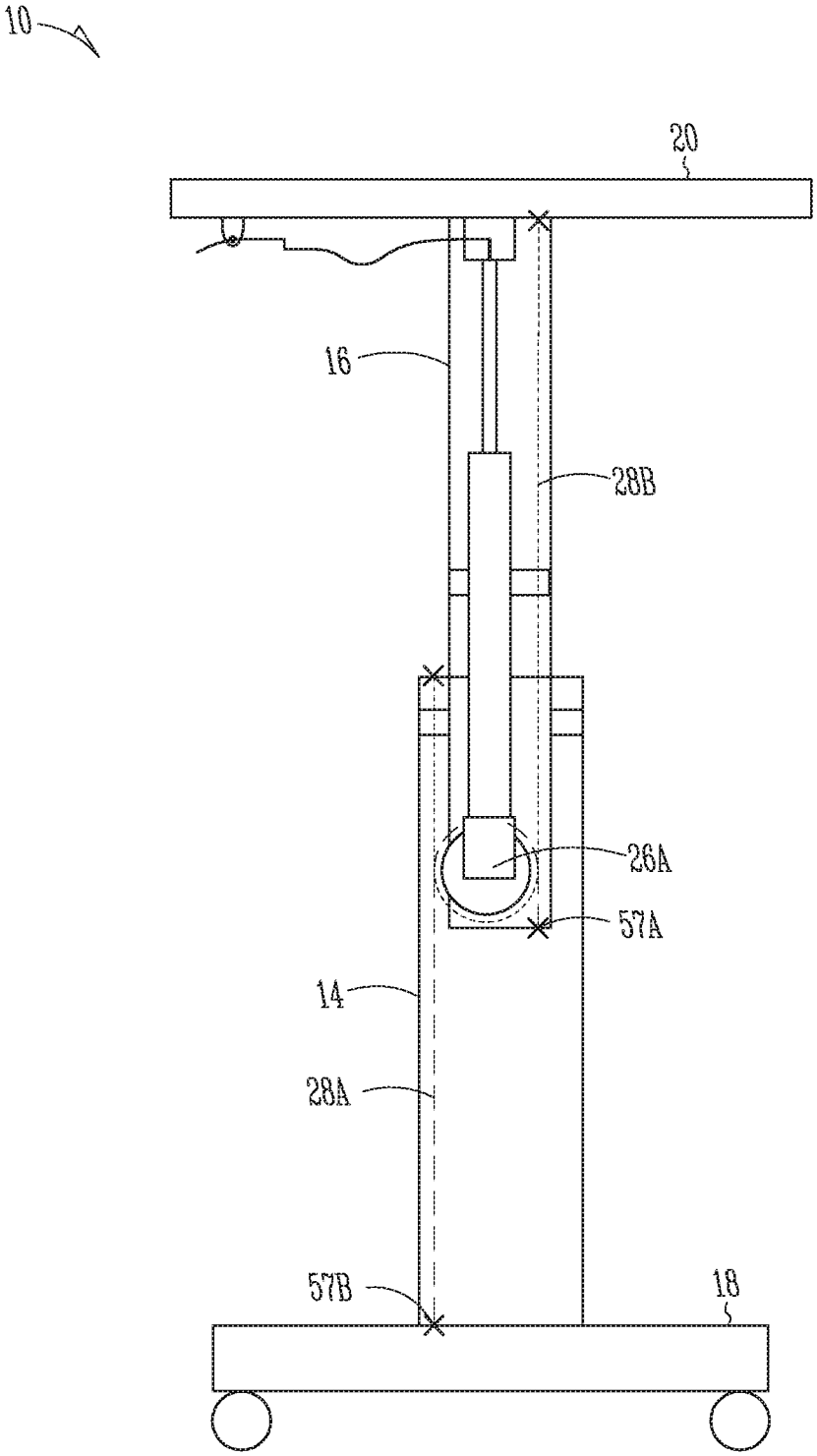
FIG. 6 illustrates a front partially cutaway view of a height adjustable device, in accordance with at least one example of the present disclosure.

FIG. 6 illustrates a front partially cutaway view of a height adjustable device 10, in accordance with at least one example of the present disclosure. In this configuration, the first tension member 28A can be routed over the first pulley 26A in an opposite direction as compared to the configuration shown in FIG. 4. In other words the first tension member 28A can be coupled to the second member at an alternate first crimp 57A (e.g. near right side of the second member 16), routed over the first pulley 26A and coupled to the base 18 or first member 14 at an alternate second crimp 57B (e.g. near left side of first member 14). The routing of the second tension member 28B can be the same as in FIG. 4. In this example, the first pulley 26A and the second pulley 26B (see FIG. 7) can rotate in the same direction while the work surface 20 is raised or lowered. In an example, the first pulley 26A and the second pulley 26B can be rotationally fixed and can also be formed as one integral part.

Figure 7A:
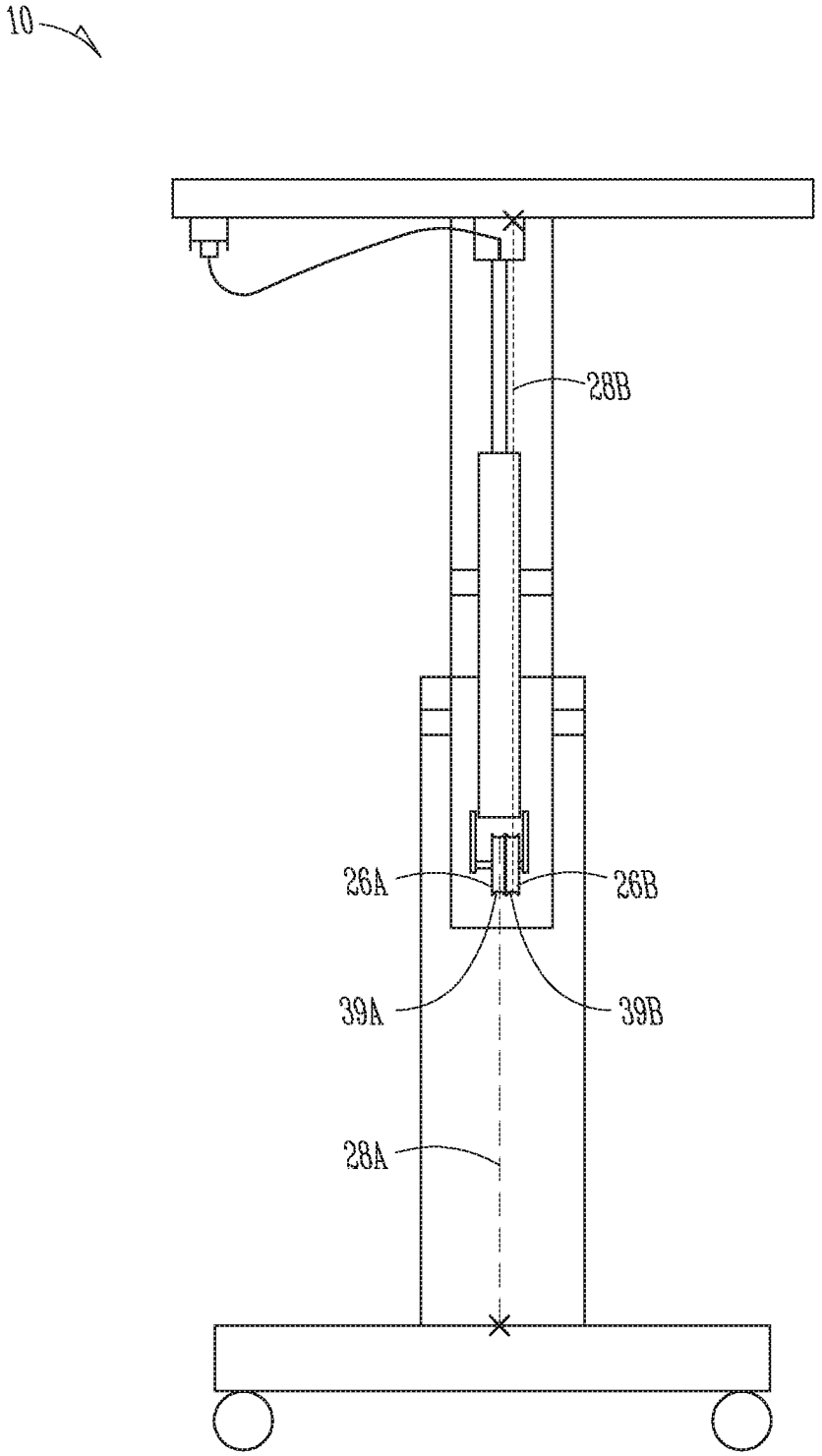
FIG. 7A illustrates a side partially cutaway view of the height adjustable device of FIG. 6, in accordance with at least one example of the present disclosure.

FIG. 7A illustrates a side partially cutaway view of the height adjustable device 10 of FIG. 6, in accordance with at least one example of the present disclosure. In an example, the first pulley 26A can be fixedly attached to the second pulley 26B. In some examples, the first pulley 26A and the second pulley 26B can be formed as one integral part. The first groove 39A can stabilize the first tension member 28A and the second groove 39B can stabilize the second tension member 28B. In an example, there can be a single pulley that includes both the first groove 39A and the second groove 39B.

Figure 7B:
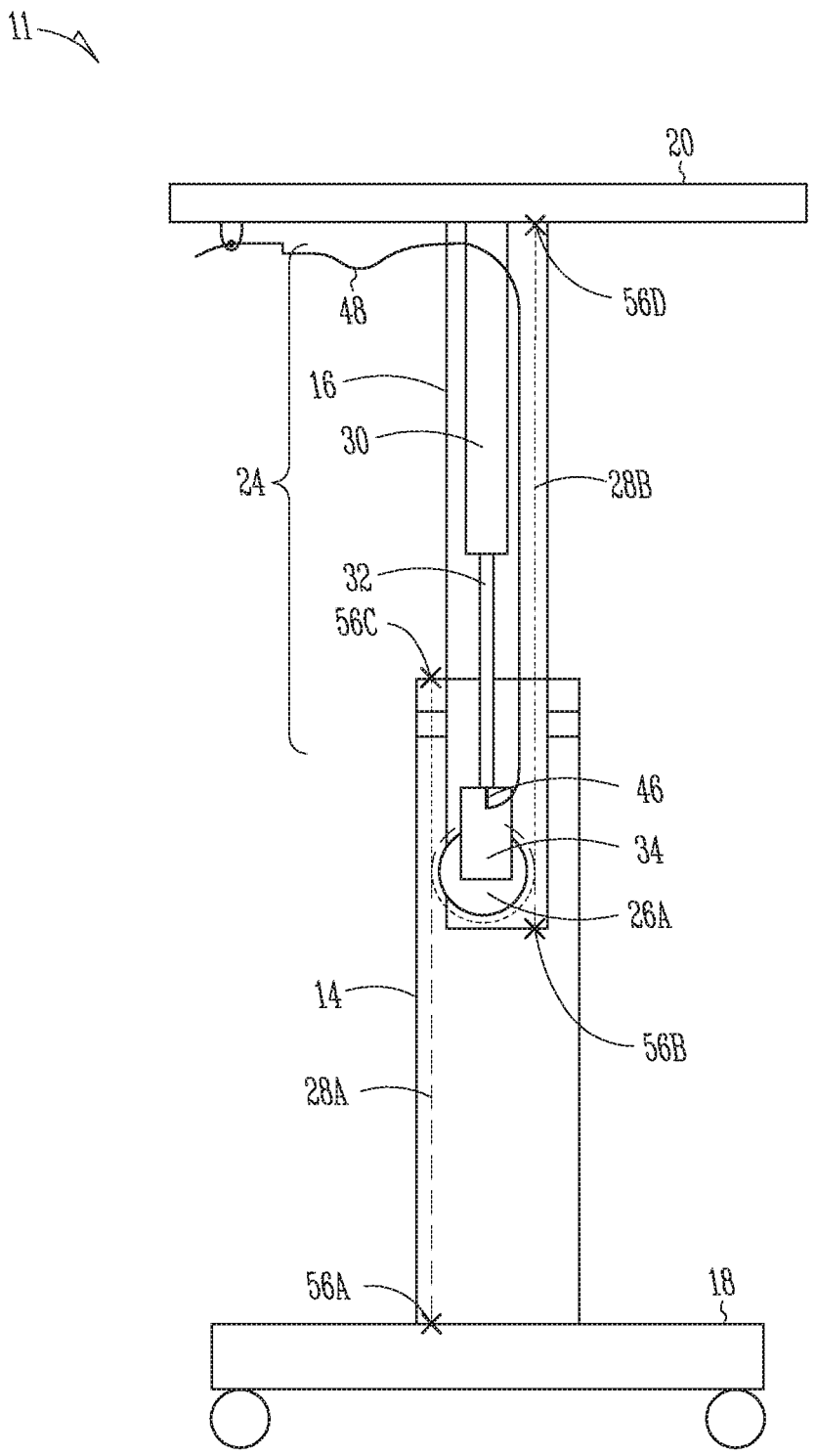
FIG. 7B illustrates a side partially cutaway view of a height adjustable device with the pulleys coupled to the piston, in accordance with at least one example of the present disclosure.

FIG. 7B illustrates a side partially cutaway view of a height adjustable device with the pulleys coupled to the piston, in accordance with at least one example of the present disclosure. In an example, a height adjustable device 11 can include many of the same attributes as the previously described examples, but can have the direction of the gas spring 24 reversed with the cylinder 30 coupled to the work surface 20 and the pulley attachment bracket 34 coupled to the piston 32. The first tension member 28A can be routed with the first crimp 56A coupled to the base 18 (or the first member 14), routed over the first pulley 26A and then coupled to the second member 16 and the second crimp 56B. The second tension member 28B can be coupled near the top of the first member at the third crimp 56C, routed around the second pulley 26B (not shown) and coupled to the bottom of the work surface 20 (or near the top of the second member 16) at the fourth crimp 561), With such a routing, the first and second pulley wheels 26A, 26B can rotate in the same direction when the second member 16 moves relative to the first member 14. In such a configuration the first pulley wheel 26A and the second pulley wheel 26B can be combined into one integral pulley wheel. In alternate examples, the tension members can be routed on the height adjustable device 11 as described previously in FIGS. 1-7A, with some examples having pulley wheels that rotate in opposite directions. In an example, the height adjustable device 11 can include a cable 48 that extends into the second member 16 to couple with the gas spring release pin 46.

Figure 8:
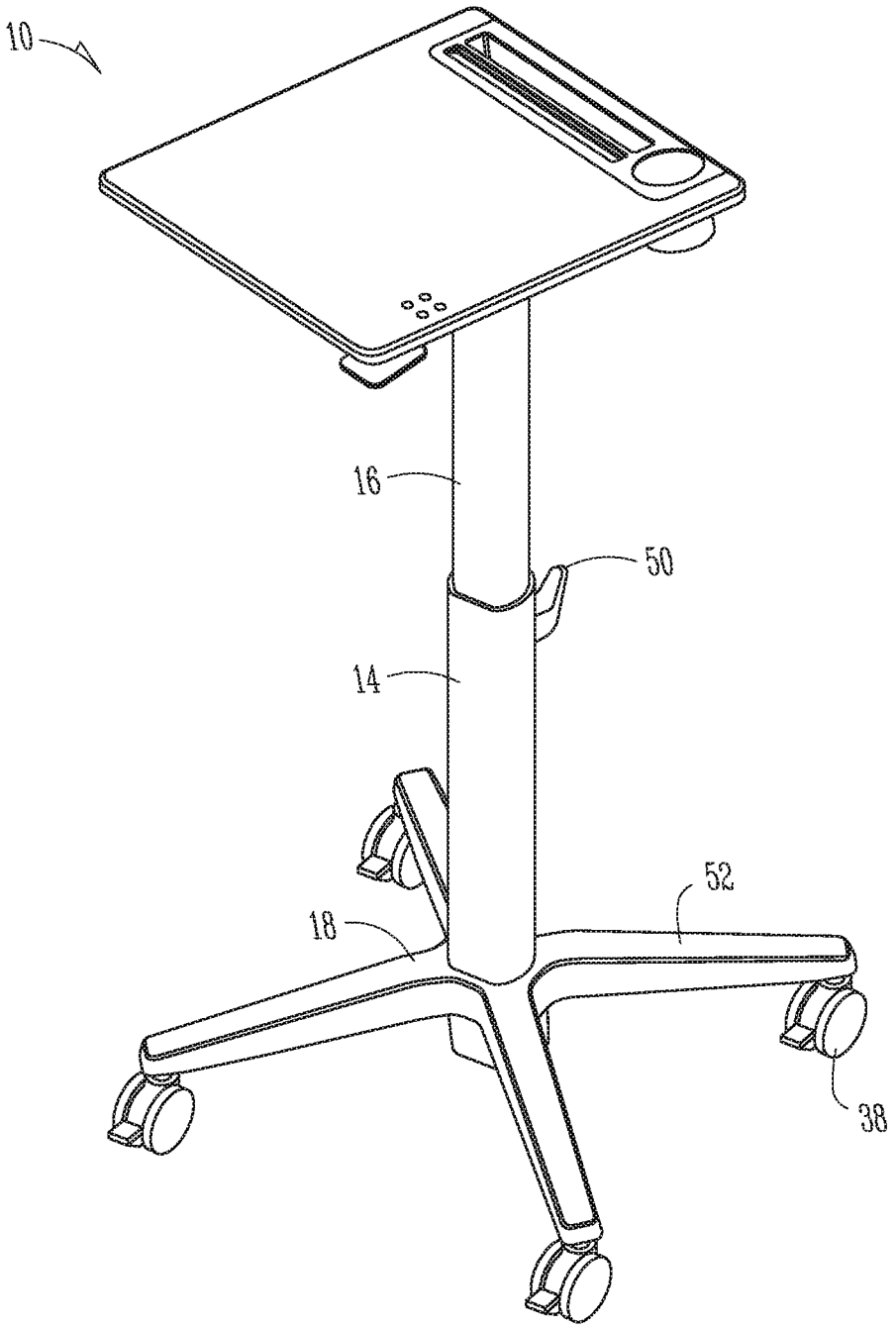
FIG. 8 illustrates a perspective view of a height adjustable device, in accordance with at least one example of the present disclosure.

FIG. 8 illustrates a perspective view of a height adjustable device 10, in accordance with at least one example of the present disclosure. In this example, the first member 14 and the second member 16 are illustrated as having a cross section that can include both curved and straight portions. Additional features can be added to the structural members of the height adjustable device 10, such as the hanging bracket 50 that can be used to organize electrical cords or personal items. The base 18 can include one or more leg members 52 that can be coupled to caster wheels 38.

Figure 9:
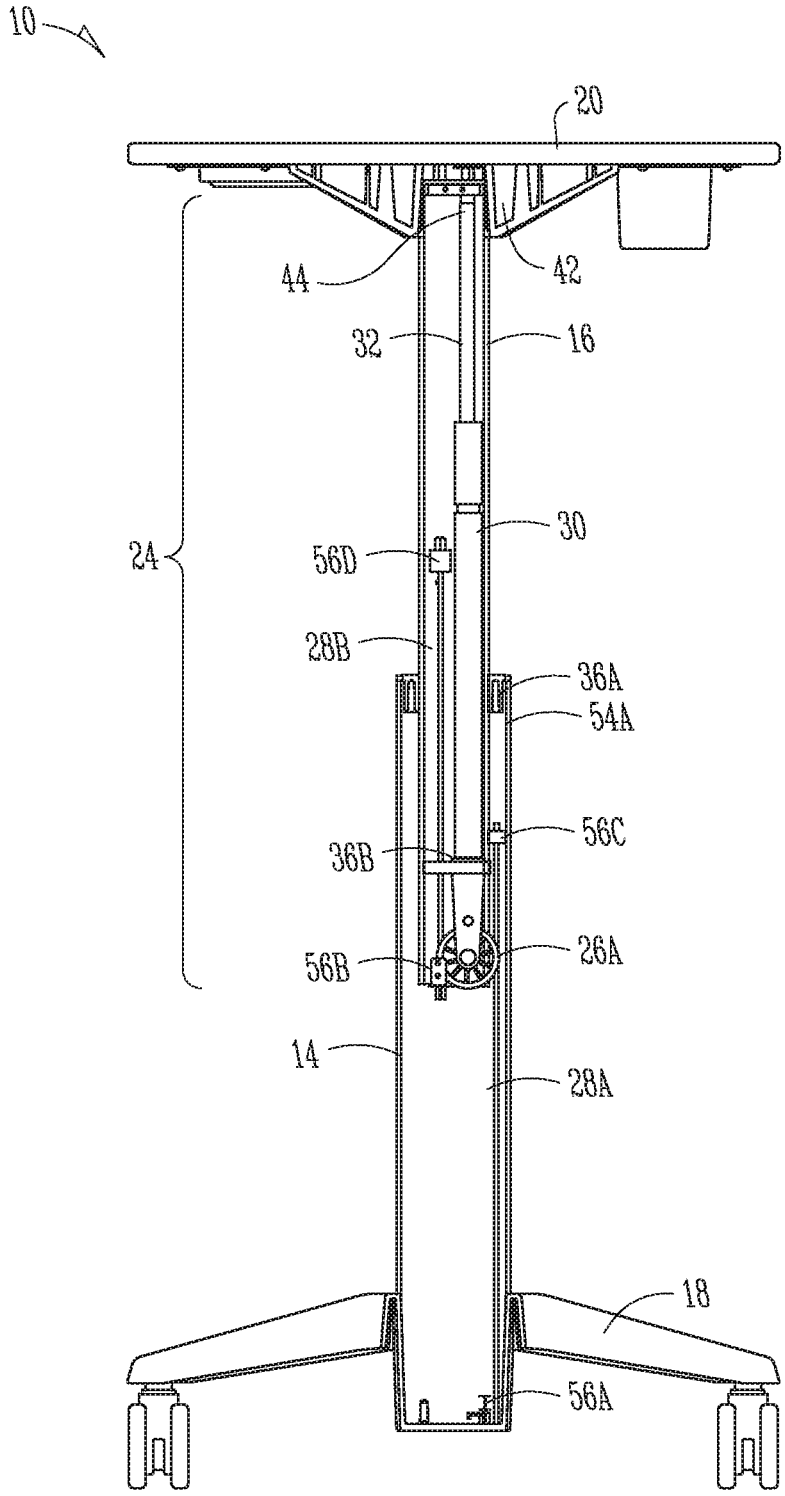
FIG. 9 illustrates a front cross section view of the height adjustable device of FIG. 8, in accordance with at least one example of the present disclosure.

FIG. 9 illustrates a front cross section view of the height adjustable device 10 of FIG. 8, in accordance with at least one example of the present disclosure. The second member 16 can be slidably engaged with the first guide member 36A that can be located near a first member upper end 54A. One end of a first tension member 28A can be attached to the first member 14 at a first crimp 56A that can be near the base 18, and can be routed around the first pulley 26A. The other end of the first tension member 28A can be attached to the second member 16 at a second crimp 56B. One end of a second tension member 28B can be attached to the first member 14 at a third crimp 56C and can be routed around the second pulley 26B (see FIG. 7). The other end of the second tension member 28B can be attached to the second member 16 at a fourth crimp 56D. The cylinder 30 can be slidably engaged with the second guide member 36B.

The height adjustable device 10 is illustrated as extended near the uppermost travel of the second member 16. The upward travel can be caused by the extension of the piston 32 from the cylinder 30. The top end 44 of the gas spring 24 can be attached to the bottom surface 42 of the work surface 20, while the cylinder 30 is free to move. The slidable engagement with the second guide member 36B can stabilize the gas spring 24. The tension members 28A, 28B can be tight against the pulleys 26A, 26B, and therefore when the cylinder 30 moves relative to the piston 32, the pulleys apply a force to the tension members. The tension members 28A, 28B transfer the force to the second member 16 which can slide relative to the first member 14. When the piston 32 retracts into the cylinder 30, the movement reverses and the second member 16 can retract downwardly into the first member 14.

Figure 10:
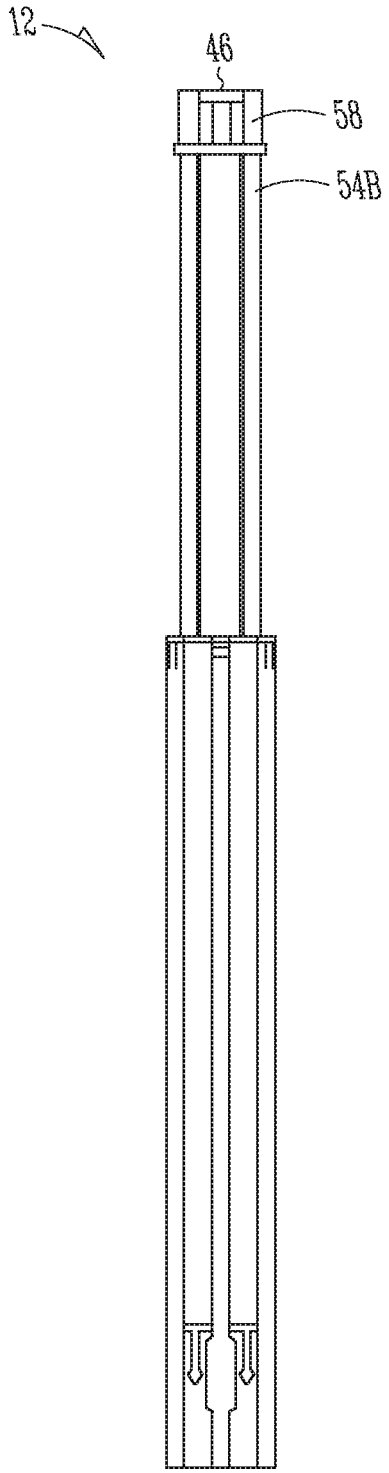
FIG. 10 illustrates a front partially cutaway view of a telescoping beam, in accordance with at least one example of the present disclosure.

FIG. 10 illustrates a front partially cutaway view of an adjustable beam 12, in accordance with at least one example of the present disclosure. The adjustable beam 12 can include a tapered sleeve 58 that can be fixedly attached to a second member upper end 54B. The tapered sleeve 58 can facilitate attachment of the adjustable beam 12 to a work surface attachment bracket 60 (see FIG. 11B). The gas spring release pin 46 can be exposed and slightly raised up from an upper surface of the tapered sleeve 58. When the adjustable beam 12 is inserted in to the work surface attachment bracket 60, the gas spring release pin 46 can contact a release pad 74 (see FIG. 13) to selectively unlock the gas spring 24 for height adjustment of the height adjustable device 10 (see FIGS. 3-10).

Figure 11A:
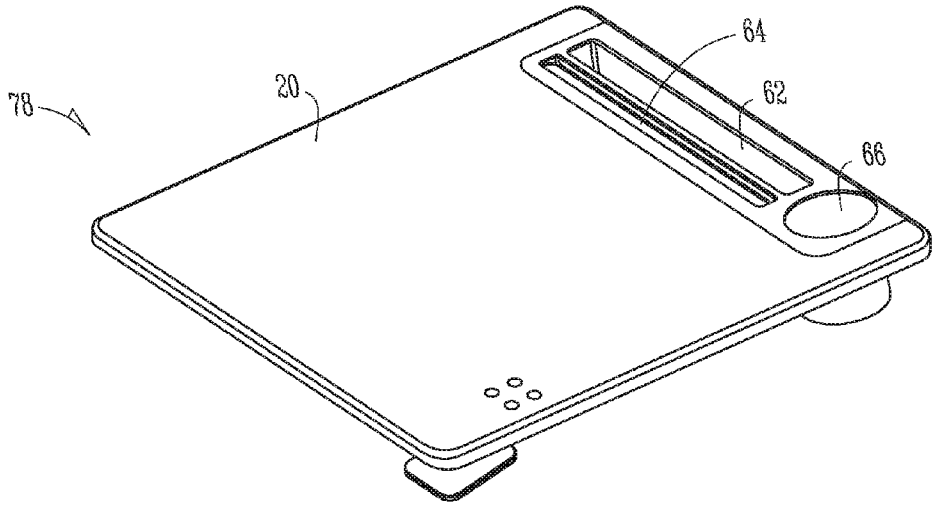
FIG. 11A illustrates a top perspective view of a work surface assembly, in accordance with at least one example of the present disclosure.

FIG. 11A illustrates a top perspective view of a work surface assembly 7 in accordance with at least one example of the present disclosure. In some examples, additional accessories such as a tablet holder 62, a pencil holder 64, and a cup holder 66 can be added to the work surface 20.

Figure 11B:
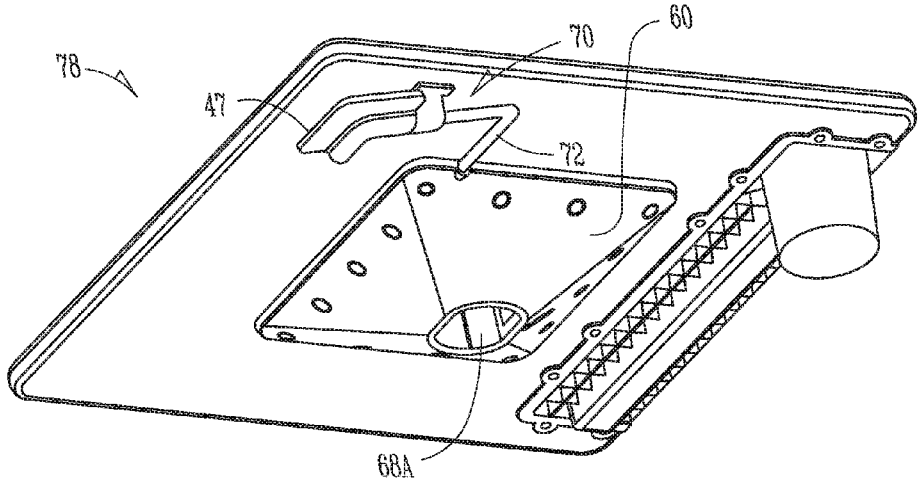
FIG. 11B illustrates a bottom perspective view of a work surface assembly, in accordance with at least one example of the present disclosure.

FIG. 11B illustrates a bottom perspective view of a work surface assembly 78, in accordance with at least one example of the present disclosure. The work surface attachment bracket 60 can include a first tapered cavity 68A that can be configured to receive and connect the tapered sleeve 58 (see FIG. 10). The release mechanism 70 can include the release lever 47, a release bar 72 as well as the release pad 74 (see FIG, 13). Actuation of the release mechanism 70 can actuate the gas spring release pin 46 (see FIG. 10) and allow the gas spring 24 (see FIG. 9) to be adjusted in length.

Figure 12A:
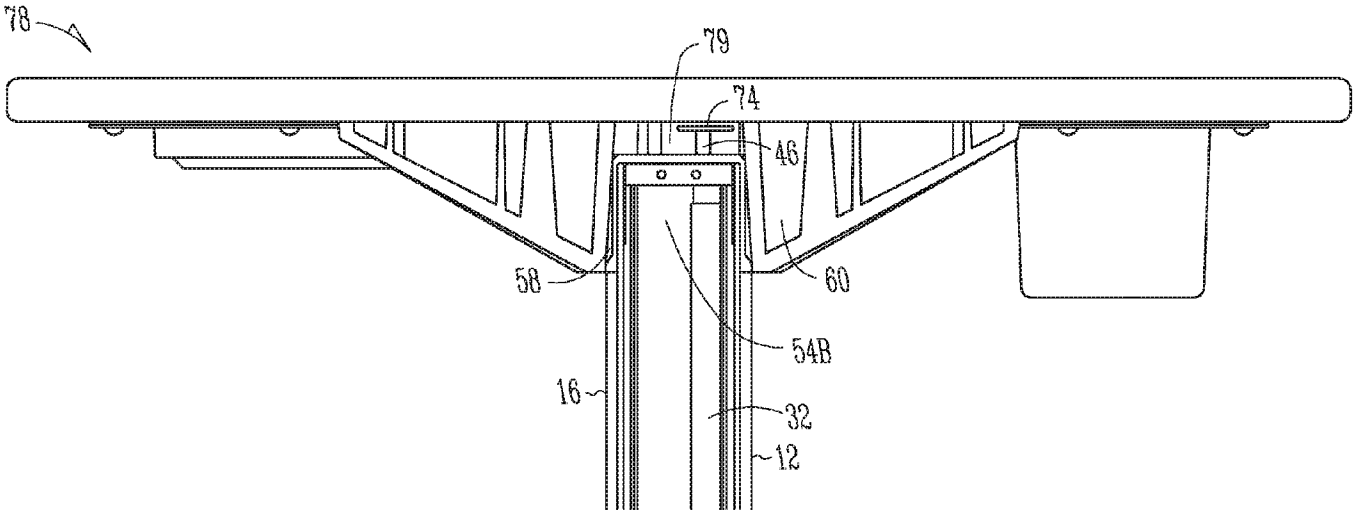
FIG. 12A illustrates a cross section view of a work surface assembly and attachment to the second member, in accordance with at least one example of the present disclosure.
Figure 12B:
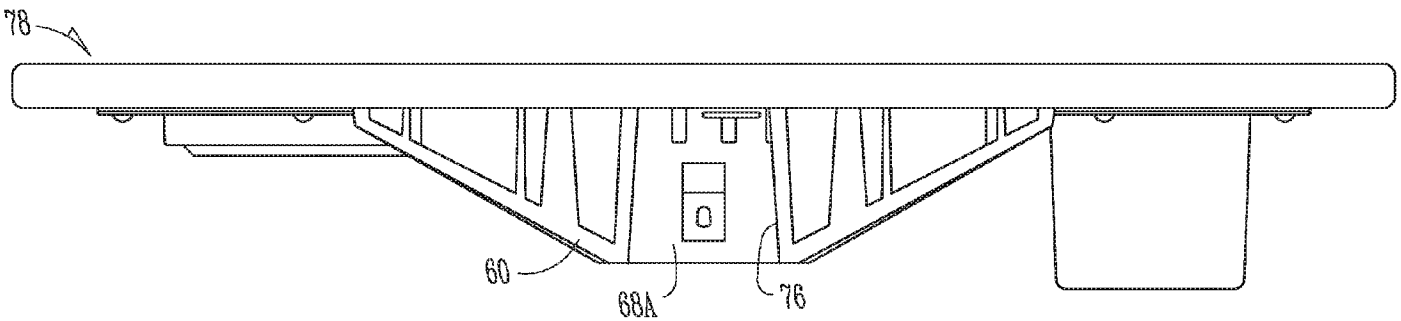
FIG. 12B illustrates a cross section view of a work surface assembly, in accordance with at least one example of the present disclosure.

FIGS. 12A-12B illustrate a cross section view of a work surface assembly 78 and attachment to the second member 16, in accordance with at least one example of the present disclosure. The work surface attachment bracket 60 can include a first tapered cavity 68A having tapered walls 76 near the center of the work surface attachment bracket 60. The tapered sleeve 58 located on second member upper end 54B can be inserted into the first tapered cavity 68A to secure the work surface assembly 78 onto the adjustable beam 12. The piston 32 can be abutted against a surface of the tapered sleeve 58 so that any force transmitted by the piston 32 can be transferred to the tapered sleeve 58 and then to the work surface assembly 78. The gas spring release pin 46 can extend through the tapered sleeve 58 and can remain unaffected by any force transmitted between the piston 32 and the work surface assembly 78. A space 79 can be defined between the tip of the gas spring release pin 46 and the release pad 74.

Figure 13:
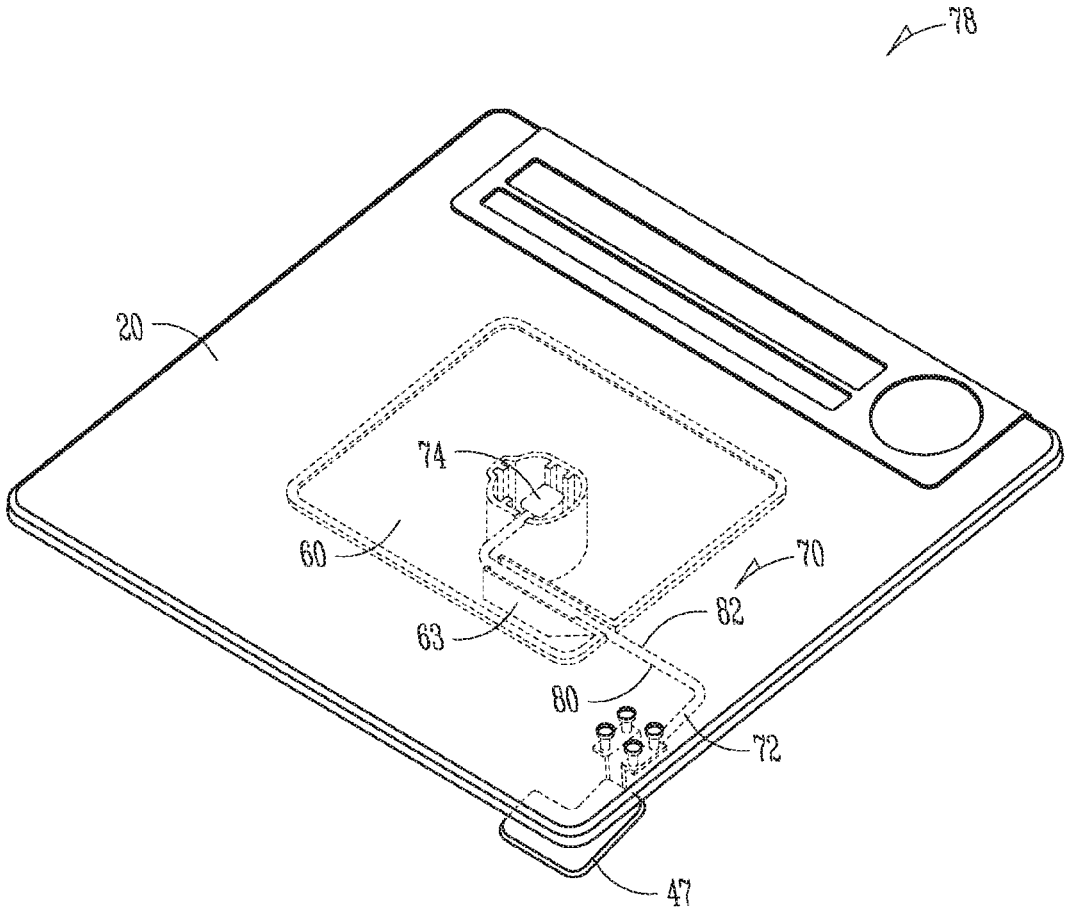
FIG. 13 illustrates a top perspective view of a work surface assembly, in accordance with at least one example of the present disclosure.

FIG. 13 illustrates a top perspective view of a work surface assembly 78, in accordance with at least one example of the present disclosure. In an example, the release mechanism 70 can be mounted underneath the work surface 20. The release mechanism 70 can include the release lever 47, the release bar 72, and the release pad 74. The release lever 47 can be fixedly attached to a first end of the release bar 72. The release pad 74 can be fixedly attached to the second end of the release bar 72. The release bar 72 can be formed of any strong structural material and can be a bent steel bar. The release bar 72 can be rotatingly coupled with the work surface attachment bracket 60. The work surface attachment bracket 60 can include a channel 63 that can receive the release bar 72. A middle section 80 of the release bar 72 can form a rotation axis 82 for the release bar 72. When the adjustable beam 12 is attached to the work surface attachment bracket 60, the gas spring release pin 46 can be located right under the release pad 74 (see FIG. 9). When a user squeezes or actuates the release lever 47, the release bar 72 can rotate and the release pad 74 can press on to the gas spring release pin 46 to unlock the gas spring 24 (see FIG, 9). In an example, the release lever 47, the release bar 72, and the release pad 74 can be formed of one or more pieces.

Figure 14:
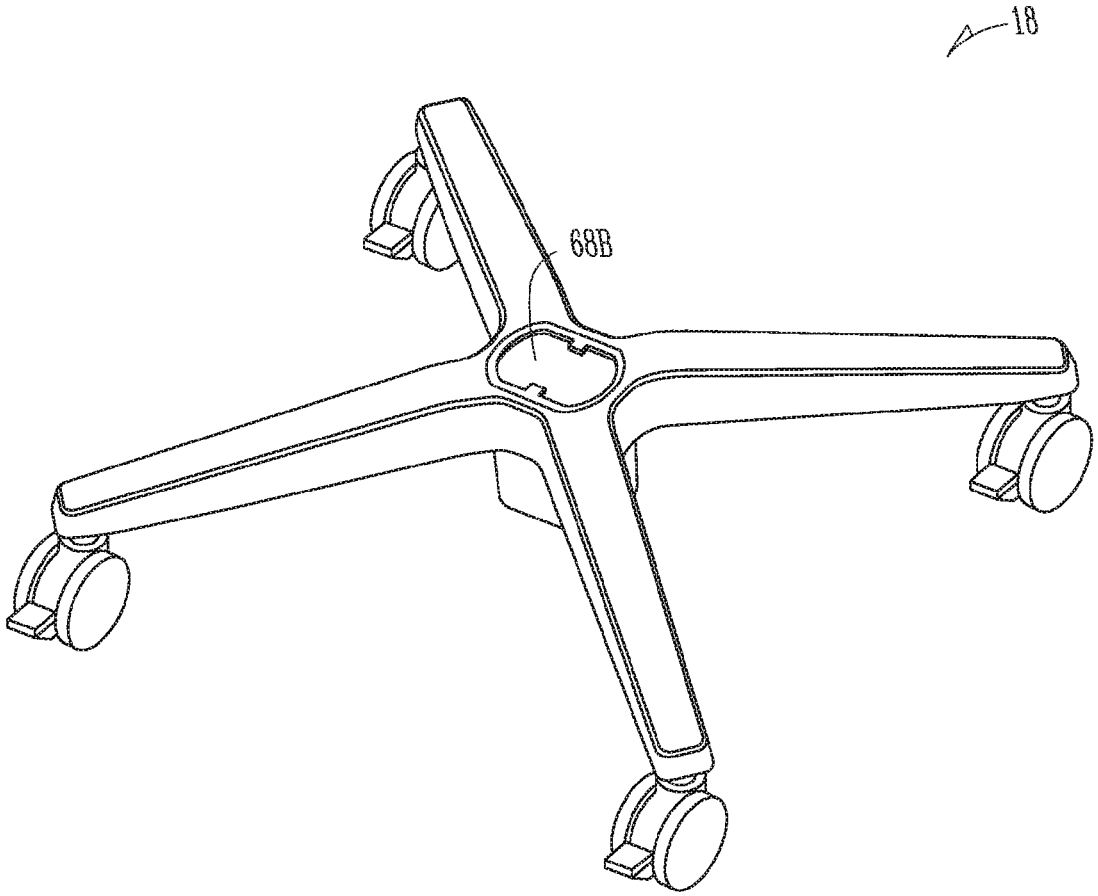
FIG. 14 illustrates a perspective view of a base, in accordance with at least one example of the present disclosure.

FIG. 14 illustrates a perspective view of a base 18, in accordance with at least one example of the present disclosure. The base 18 can include a second tapered cavity 68B that can facilitate the mounting of the first member 14 (see FIG. 15A).

Figure 15A:
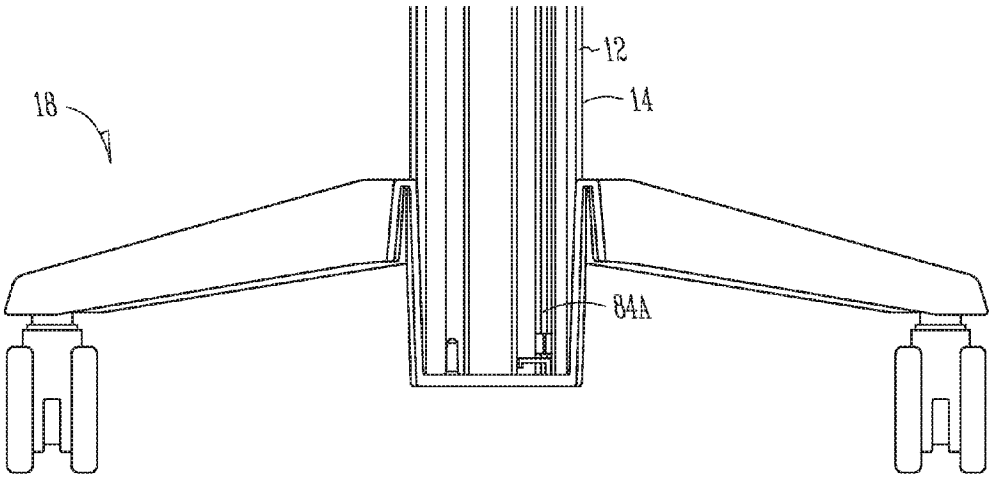
FIG. 15A illustrates a cross section view of a base and first member attachment, in accordance with at least one example of the present disclosure.
Figure 15B:
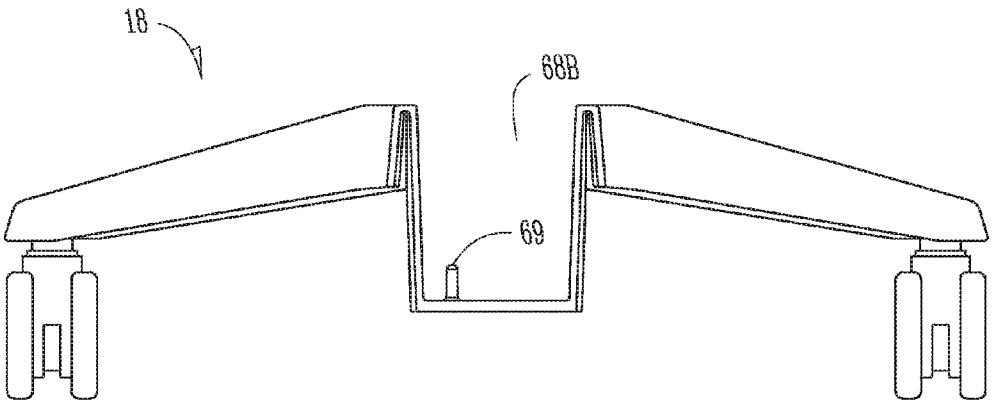
FIG. 15B illustrates a cross section view of a base, in accordance with at least one example of the present disclosure.

FIGS. 15A-B illustrate a cross section view of the base 18 and the first member 14 attachment, in accordance with at least one example of the present disclosure. The second tapered cavity 68B can be formed as an integral part of the base 18. A first member lower end 84A can be inserted in to the second tapered cavity 68B to secure the adjustable beam 12 to the base 18. A locating pin 69 can be provided in the base 18 to aid in assembling the first member 14 to the base 18.

Figure 16:
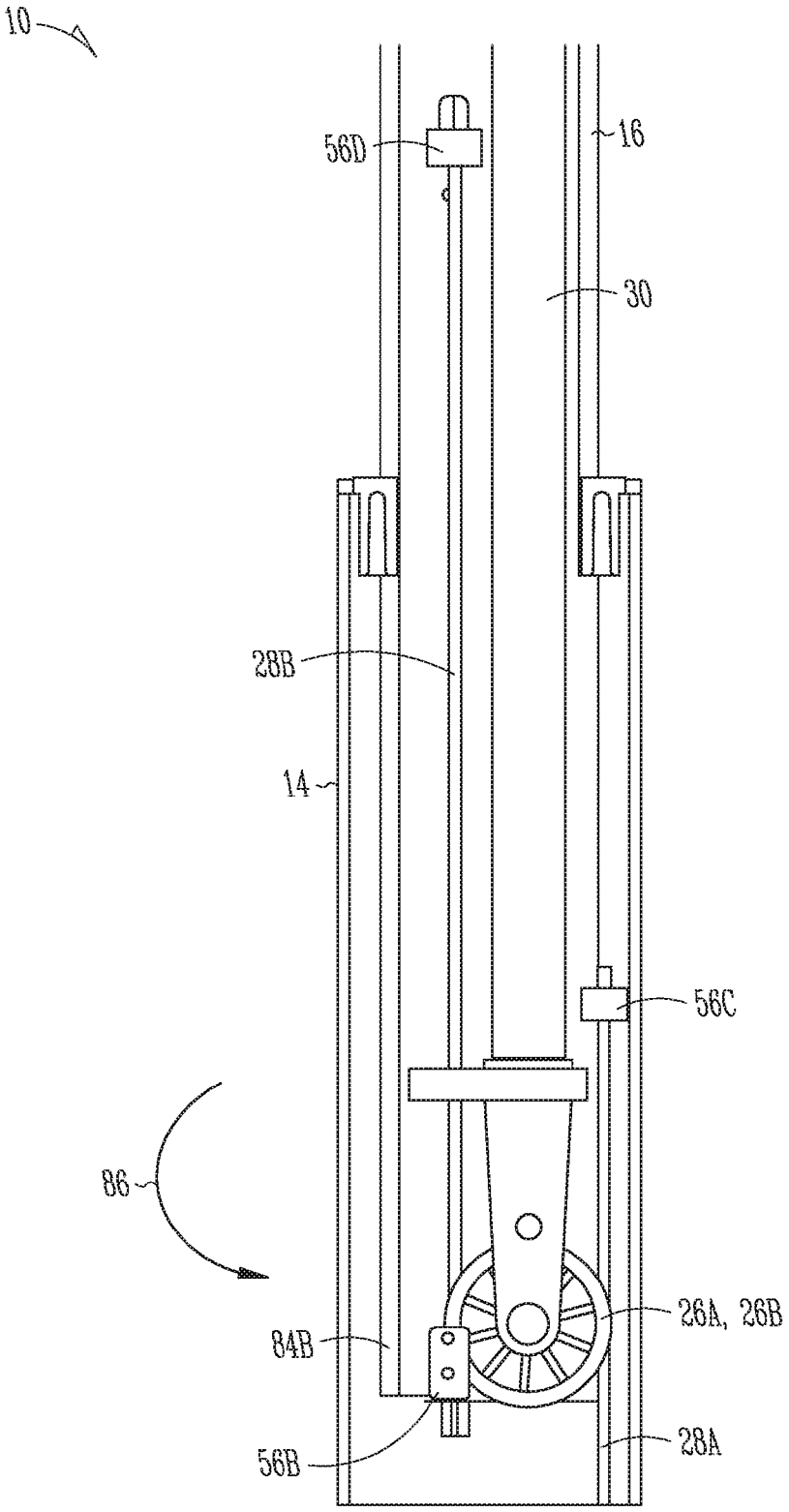
FIG. 16 illustrates a front partially cutaway view of lift mechanism, in accordance with at least one example of the present disclosure.

FIG. 16 illustrates a front partially cutaway view of the height adjustable device 10, in accordance with at least one example of the present disclosure. In an example, the cylinder 30 can be located at a fill extension position. The second crimp 56B can be fixed near the second member lower end 84B. To visualize how the height adjustable device 10 moves, as the gas spring 24 retracts and the piston 32 (see FIG. 9) moves back into the cylinder 30, the total length of the gas spring 24 becomes less. Even though the tension on the first and second tension members 28A, 28B may not change, the position of the first and second pulleys 26A, 26B on the tension members 28A, 28B can change as the gas spring 24 retracts. In the illustrated example, as the gas spring retracts, the pulleys 26A, 26B can rotate in a counter clockwise 86 fashion and the pulleys 26A, 26B move from a position relative to the tension members 28A, 28B illustrated that is close to the second crimp 56B and third crimp 56C to a position that is closer to the first crimp 56A (see FIG. 9) and fourth crimp 56D. The movement can cause the second member to be retracted into the first member 14 and the height of the work surface 20 to be lowered. Raising the work surface 20 can reverse the operation and the pulleys 26A, 26B can move in a clock wise direction. As previously described the tension members 28A, 28B can be arranged so that the first and second pulleys 26A, 26B are not rotationally fixed and can turn in opposite directions.

The present inventors have fully contemplated a height adjustable device in accordance with the present disclosure having a third member or a fourth member that telescope using the same or alternate principals as described herein.

The above detailed description includes references to the accompanying drawings, which form a part of the detailed description. The drawings show, by way of illustration, specific embodiments in which the invention can be practiced. These embodiments are also referred to herein as "examples." Such examples can include elements in addition to those shown or described. However, the present inventors also contemplate examples in which only those elements shown or described are provided. Moreover, the present inventors also contemplate examples using any combination or permutation of those elements shown or described (or one or more aspects thereof), either with respect to a particular example (or one or more aspects thereof), or with respect to other examples or one or more aspects thereof) shown or described herein.

All publications, patents, and patent documents referred to in this document are incorporated by reference herein in their entirety, as though individually incorporated by reference. In the event of inconsistent usages between this document and those documents so incorporated by reference, the usage in the incorporated reference(s) should be considered supplementary to that of this document; for irreconcilable inconsistencies, the usage in this document controls.

In this document, the terms "a" or "an" are used, as is common in patent documents, to include one or more than one, independent of any other instances or usages of "at least one" or "one or more." In this document, the term "or" is used to refer to a nonexclusive or, such that "A or B" includes "A but not B," "B but not A," and "A and B," unless otherwise indicated. In the appended claims, the terms "including" and "in which" are used as the plain-English equivalents of the respective terms "comprising" and "wherein." Also, in the following claims, the terms "including" and "comprising" are open-ended, that is, a system, device, article, or process that includes elements in addition to those listed after such a term in a claim are still deemed to fall within the scope of that claim. Moreover, in the following claims, the terms "first," "second," and "third," etc. are used merely as labels, and are not intended to impose numerical requirements on their objects.

The above description is intended to be illustrative, and not restrictive. For example, the above-described examples (or one or more aspects thereof) may be used in combination with each other. Other embodiments can be used, such as by one of ordinary skill in the art upon reviewing the above description. The Abstract is provided to comply with 37 C.F.R. §1.72(b), to allow the reader to quickly ascertain the nature of the technical disclosure. It is submitted with the understanding that it will not be used to interpret or limit the scope or meaning of the claims. Also, in the above Detailed Description, various features may be grouped together to streamline the disclosure. This should not be interpreted as intending that an unclaimed disclosed feature is essential to any claim. Rather, inventive subject matter may lie in less than all features of a particular disclosed embodiment. Thus, the following claims are hereby incorporated into the Detailed Description, with each claim standing on its own as a separate embodiment, and it is contemplated that such embodiments can be combined with each other in various combinations or permutations. The scope of the invention should be determined with reference to the appended claims, along with the full scope of equivalents to which such claims are entitled.

What is clamed is:

1. A height adjustable device comprising:
a work surface; and
at least one leg assembly connected to the work surface, the at least one leg assembly including:
a first member;
a second member moveable relative to the first member along a longitudinal axis;
a counterbalance mechanism coupled to the at least one leg assembly and configured to counteract a force exerted on the work surface, the counterbalance mechanism including:
a gas spring having a cylinder and a moveable piston;
a wheel assembly moveably connected to the gas spring; and
a first tension member having a first end and a second end, the first tension member engaged to the wheel assembly, the first tension member connected to the at least one leg assembly, wherein the first end and the second end extend away from the wheel assembly in a first direction;
a second tension member having a third end and a fourth end, the second tension member engaged to the wheel assembly, the second tension member connected to the at least one leg assembly, wherein the third end and the fourth end extend away from the wheel assembly in a second direction that is opposite the first direction; and
a guide member mounted inside of one of the first member and the second member, the guide member being slidably engaged with the cylinder.

2. The height adjustable device of claim 1, wherein the cylinder is configured to move within the at least one leg assembly when the moveable piston moves.

3. The height adjustable device of claim 1, wherein the second member slides within the first member in a telescoping configuration.

4. The height adjustable device of claim 1, further comprising a release mechanism configured to release the gas spring.

5. The height adjustable device of claim 4, wherein the release mechanism includes a release bar having a middle section configured to coincide with a rotation axis.

6. The height adjustable device of claim 1, wherein a distal end of the moveable piston is coupled to the work surface.

7. The height adjustable device of claim 1, further comprising a third member moveable relative to the first member and the second member along the longitudinal axis.

8. The height adjustable device of claim 1, wherein the guide member is mounted inside of the second member.

9. The height adjustable device of claim 1, further comprising a wheeled base having a tapered cavity configured to receive the first member.

10. A height adjustable device comprising:
a work surface; and
at least one leg assembly connected to the work surface, the at least one leg assembly including:
a first member; and
a second member moveable relative to the first member along a longitudinal axis;
a counterbalance mechanism coupled to the at least one leg assembly and configured to counteract a force exerted on the work surface, the counterbalance mechanism including:
gas spring having a cylinder and a moveable piston;
a first wheel moveably connected to the gas spring;
a second wheel moveably connected to the gas spring; and
a first tension member having a first end and a second end, the first tension member engaged to the first wheel, the first tension member connected to the at least one leg assembly, wherein the first end and the second end extend away from the first wheel in a first direction;
a second tension member having a third end and a fourth end, the third end engaged to the second wheel, the second tension member connected to the at least one leg assembly, wherein the third end and the fourth end extend away from the second wheel in a second direction that is opposite the first direction; and
a guide member mounted inside of one of the first member and the second member, the guide member being slidably engaged with the cylinder.

11. The height adjustable device of claim 10, wherein the first wheel and the second wheel rotate about a first axis.

12. The height adjustable device of claim 10, wherein the first and second tension members are configured such that the first and second wheels rotate in the same direction when the second member moves.

13. The height adjustable device of claim 10, wherein the first and second tension members are configured such that the first and second wheels rotate in opposite directions when the second member moves.

14. The height adjustable device of claim 10, further comprising a release mechanism configured to release the gas spring.

15. The height adjustable device of claim 10, wherein the release mechanism includes a release bar having a middle section configured to coincide with a rotation axis.

16. The height adjustable device of claim 10, wherein a distal end of the moveable piston is coupled to the work surface.

17. The height adjustable device of claim 10, further comprising a third member moveable relative to the first member and the second member along the longitudinal axis.

18. The height adjustably device of claim 10, wherein the guide member is mounted inside of the second member.

19. The height adjustable device of claim 10, wherein the second member slides within the first member in a telescoping configuration.

20. A height adjustable device comprising:

a work surface; and at least one leg assembly connected to the work surface, the at least one leg assembly including:

a first member; and a second member moveable relative to the first member along a longitudinal axis in a telescoping configuration;

a counterbalance mechanism coupled to the at least one leg assembly and configured to counteract a force exerted on the work surface, the counterbalance mechanism including:

a gas spring having a cylinder and a moveable piston, moveable piston coupled to the work surface;

a first wheel moveably connected to gas spring;

a second wheel moveably connected to the gas spring, wherein the first and second wheels rotate about a common axis;

a first tension member having a first end and a second end, the first tension member engaged to the first wheel, the first tension member connected to the at least one leg assembly, wherein the first end and the second end extend away from the first wheel in a first direction;

a second tension member having a third end and a fourth end, the second tension member engaged to the second wheel, the second tension member connected to the at least one leg assembly, wherein the third end and the fourth end extend away from the second wheel in a second direction that is opposite the first direction, wherein the first and second tension members are configured such that the first and second wheels rotate in opposite directions when the second member moves; and a guide member mounted inside of one of the first member and the second member, the guide member being slidably engaged with the cylinder, wherein the cylinder is configured to move within the at least one leg assembly when the moveable piston moves.

* * * * *